United States Patent [19]

Glas

[11] Patent Number: 4,598,762

[45] Date of Patent: Jul. 8, 1986

[54] PLUNGER FOR A CASTING MACHINE

[76] Inventor: Friedrich Glas, Siebenbürger Str. 30, D-8192 Geretsried, Fed. Rep. of Germany

[21] Appl. No.: 575,983

[22] Filed: Feb. 1, 1984

[30] Foreign Application Priority Data

Feb. 18, 1983 [DE] Fed. Rep. of Germany ..... 3305594

[51] Int. Cl.[4] ..... B22D 17/20

[52] U.S. Cl. ..... 164/312; 92/1; 92/186; 164/348

[58] Field of Search ..... 164/485, 122, 144, 348, 164/297, 312; 92/1, 186

[56] References Cited

U.S. PATENT DOCUMENTS 4,311,185 1/1982 Zimmermann ..... 164/312
4,334,575 6/1982 Miki et al. ..... 164/113

FOREIGN PATENT DOCUMENTS 2233132 1/1974 Fed. Rep. of Germany ..... 164/312
2904883 7/1979 Fed. Rep. of Germany ..... 164/312

*Primary Examiner*—Nicholas P. Godici
*Assistant Examiner*—Carmine Cuda
*Attorney, Agent, or Firm*—Kuhn Muller and Bazerman

[57] ABSTRACT

In a plunger for a cold chamber casting machine a mouth piece is positioned and held by only three small holding elements equally spaced in peripheral direction and fastened at plunger components. A cooling liquid pipe extends into the plunger. Between the front wall and the back wall of the plunger and the mouth piece, endside flow chambers are formed respectively communicating with the annular flow chamber formed between the plunger casing and the mouth piece along the whole circumference. Therefore the inside faces of the plunger end walls are completely accessible to cooling liquid and the plunger end walls are effectively cooled.

10 Claims, 8 Drawing Figures

PLUNGER FOR A CASTING MACHINE

BACKGROUND OF THE INVENTION

The invention relates to a plunger for a cold chamber type casting machine comprising a hollow shaft fastened at the plunger, a cooling liquid pipe arranged within the shaft with a radial interspace and projecting axially beyond the shaft and into a tube-like body arranged within the plunger forming an annular chamber between the tube-like body and the plunger casing, the annular chamber at both plunger ends communicating with the front opening of the cooling liquid pipe and with a back flow channel respectively formed between the shaft and the pipe.

A plunger of this kind is known from the DE-Patent 2 233 132. The known plunger is a multi-part structure. The front wall and the tube-like body are integrally formed. For communication between the annular chamber and the outlet opening of the cooling liquid pipe and the back flow channel respectively only small bores are provided one at the front end of the tube-like body and one at the rear end thereof. The liquid throughput and therefore the cooling effect are limited. Because of the small cross-section of the bores lime deposits will contract the small bores, additionally. The liquid flow is further obstructed and the danger exists that the cooling is completely interrupted with the result that at least the plunger can be destroyed.

From U.S. Pat. No. 4 334 575 a plunger is known which completely dispenses with a tube-like body for a controlled forced liquid flow. The cooling liquid pipe simply runs into the hollow plunger chamber. No doubt the danger of choking thereby is avoided but the cooling effect is remarkably reduced, because dead flow areas will exist and the cooling liquid leaving the feeding pipe can directly flow back into the back flow channel and the liquid at the front wall of the plunger remains substantially stationary and will not be exchanged.

Therefore it is one object of the invention to provide a plunger of the kind mentioned at the beginning comprising a tube-like body for producing a forced liquid flow in which plunger the heat transfer from the plunger to the cooling liquid is improved and the lifetime of the plunger is increased.

A further object of the invention is to provide a plunger which supplies a continuous liquid flow within the plunger exposing large areas of the plunger front wall to the cooling liquid.

One further object is to provide a plunger in which the tube-like body has a shape and is arranged such that flow obstructions of the cooling liquid are reduced to a minimum.

Last but not least it is one object of the invention to provide a novel plunger which completely avoids any choking of the flow channel system within the plunger.

SUMMARY OF THE INVENTION

The plunger according to this invention comprising features of the known plunger mentioned at the beginning is characterized in that said tube-like body is formed as a mouth piece substantially completely surrounded by the cooling liquid, at least two holding means are provided substantially non-obstructing the liquid flow and holding the mouth piece in a coaxial position spaced from the plunger front wall, said holding means are arranged between the plunger and the mouth piece and connected therewith in such manner that a front-side flow chamber is formed between the mouth piece and the plunger front wall, and that the aforesaid annular chamber substantially communicates with said flow chamber around the full circumference thereof.

Due to the favorable shape of the mouth piece and the mounting principle thereof in the plunger comprising preferably only two or three thin holding elements or components circumferentially offset with equal interspaces at the whole inner surface of the thermal high-loaded plunger front wall a continuous uniform liquid flow is maintained in the most advantageous flow pattern of a rotational symmetrical source or spring flow which is characterized in that the moving paths of all liquid particles leaving the feed pipe axially are continuously deflected into radial directions, all moving paths are identical and are equally distributed over the whole circumference in the form of a rotational solid.

Further objects, features and advantages will become apparent from the following description of some embodiments of the invention in connection with the drawings which are all illustrative and not limitative.

DETAILED DESCRIPTION

Figure 1:
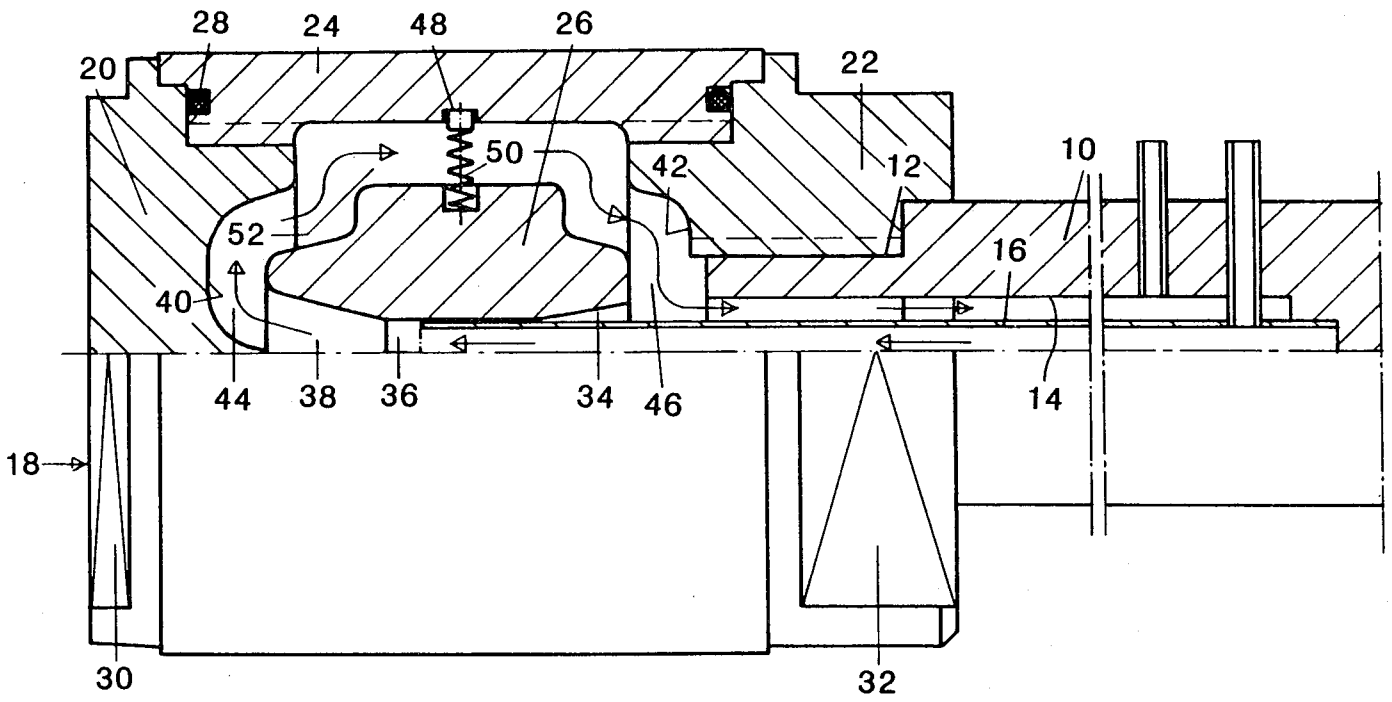
FIG. 1 shows a cross-sectional view of a plunger comprising a mouth piece supported at the periphery thereof.

In all FIGURES the parts belonging to the cold chamber type casting machine are shown with dot and dashes,i.e. the front end of a hollow plunger shaft 10, an outside thread 12 provided at the front end of the shaft 10, an axial bore 14, within the shaft 10, a cooling liquid pipe 16 coaxially arranged within the shaft leaving a radial interspace therebetween, the cooling liquid pipe 16 axially projecting beyond that shaft 10. The cooling liquid flows through the pipe 16 into the interior of a plunger 18 and leaves the plunger 18 through a back flow channel formed between bore 14 of shaft 10 and pipe 16.

Figure 2:
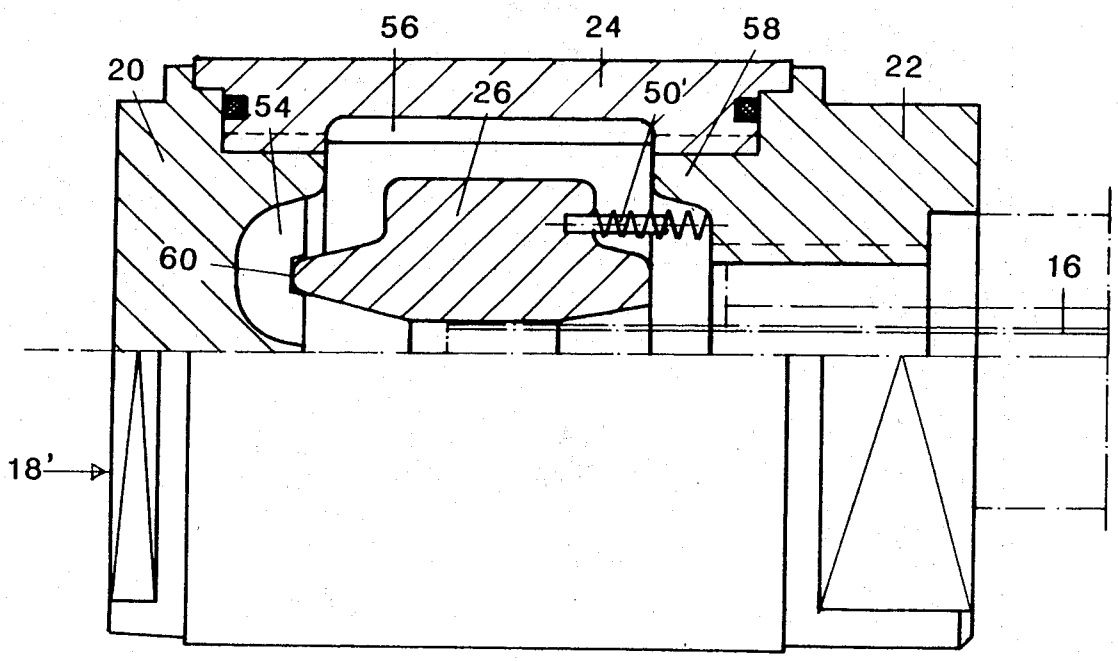
FIG. 2 shows a plunger comprising an axially supported mouth piece.

The plunger 18 comprises a front wall 20 having a hexagonal opening 30 at the front outside, a back wall 22 screwed on the shaft front end and formed with outside hexagonal faces 32, a plunger casing 24 and a mouth piece 26 arranged within the plunger 18. In FIGS. 1 and 2 the casing 24 is shown as being screwed on both said plunger end walls 20, 22, sealing rings 28 being arranged therebetween. The interior of the mouth piece 26 is composed of a cylindrical middle portion 36 and adjacent end portions 34, 38 continuously enlarging in opposite directions to the end faces of the mouth piece 26 respectively. The mouth piece 26 is spaced from the inside face 40 of the front wall 20 and is also spaced from the inside face 42 of the back wall 22 thereby forming flow chambers 44, 46 which communicate with the annular chamber 52 between casing 24 and mouth piece 26 around the whole circumference without any obstructions respectively. The inside face 40 of the front wall 20 is provided with an axially recessed annular area arranged between a central area and an annular area adjoining radially outwards. The transitions are curved in axial direction and in peripheral direction so that the central area gets a continuous tapering shape in rearward direction. In connection with the continuously enlarging end portion 38 of the mouth piece 26 a flow channel is formed having best flow properties and avoiding any dead areas, the axial section thereof being substantially U-shaped. The whole inside face 40 of the front wall 20 thereby is completely accessible to cooling liquid.

An annular recess 48 is formed at the inside peripery of the plunger casing 24. Three small resilient holding elements 50 circumferentially fastened with equal interspaces at the mouth piece 26 engage with that annular recess 48. Thereby the mouth piece 26 without difficulties can be mounted within the plunger casing. The mouth piece 26 is self-adjustable in radial direction, whereby any problems with the axial displacement of the cooling liquid pipe 16 into the mouth piece 26 during assembling are avoided. Further the mouth piece 26 is mounted for axial displacement within the plunger 18 between end stops so that the mouth piece 26 will adjust itself in axial direction dependent on the hydrostatic pressures within both opposite flow chambers 44, 46.

The plunger 18' shown in FIG. 2 is provided at its front wall 20 with radial cooling ribs 54 and at its casing 24 with axial cooling ribs 56. Three axial pins 50' spaced equally in peripheral direction project rearwardly from the rearward end face of the mouth piece 26. Axial springs are arranged on these pins 50', the rearward ends thereof engage with an annular shoulder 58 of the back wall 22 and are rested axially at the back wall 22. The front end of the mouth piece 26 projects into recesses 60 of the ribs 54 of the front wall 20.

After having disassembled the plunger 18' the mouth piece 26 maintains its position within the plunger although the cooling liquid pipe 16 has been extracted. In operating position the pipe 16 engages into the cylindrical middle portion 36 of the mouth piece 26, which is displaced rearwardly by the cooling liquid and guided by pipe 16. The mouth piece 26 adjusts itself in correspondence with the hydrostatic pressures in the flow end chambers 44, 46.

Figure 3:
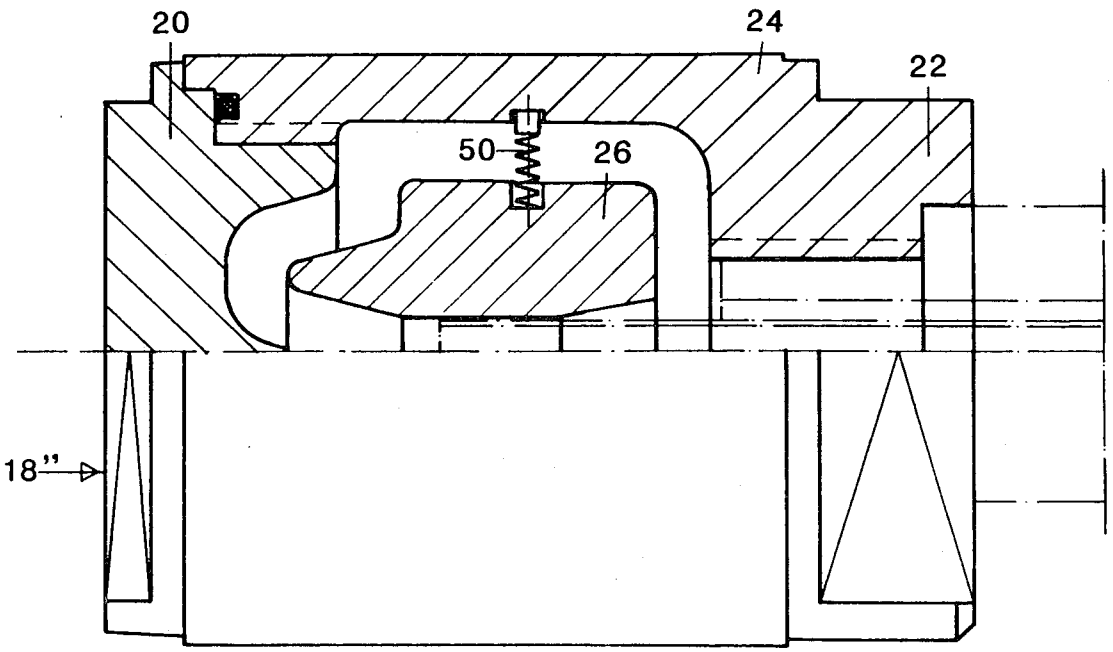
FIG. 3 shows a plunger comprising a mouth piece similar to FIG. 1, however the casing of the plunger and the back end wall thereof are integrally formed.

The plunger 18'' according to FIG. 3 differs from plunger 18 according to FIG. 1 in that the back wall 22 is integrally formed with the casing 24.

Figure 4:
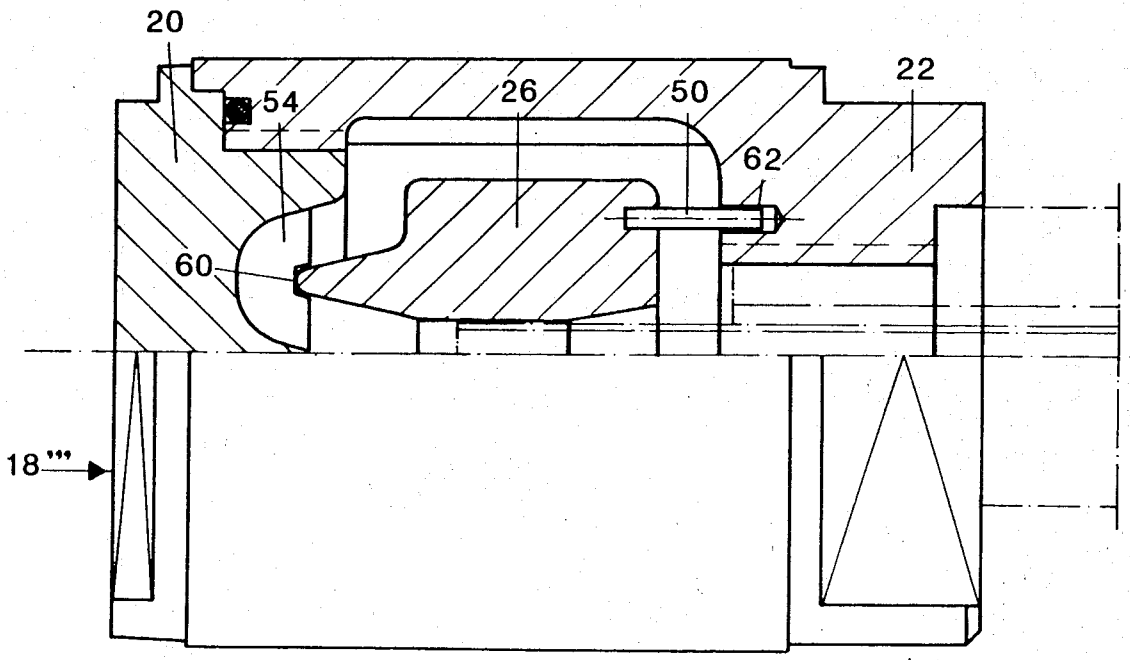
FIG. 4 shows a plunger similar to FIG. 3 the mouth piece thereof being mounted for axial displacement.

The plunger 18''' according to FIG. 4 is provided with an axially self-adjustable mouth piece 26. Three axial pins 50'' project rearwardly from the rearward end face of the mouth piece and displaceably extend into pocket holes 62 provided in the plunger back wall 22. The three axial pins 50'' are equally spaced in circumferential direction. The mouth piece 26 due to the self-adjusting principle thereof provides for an optimum of cooling liquid throughput.

Figure 5:
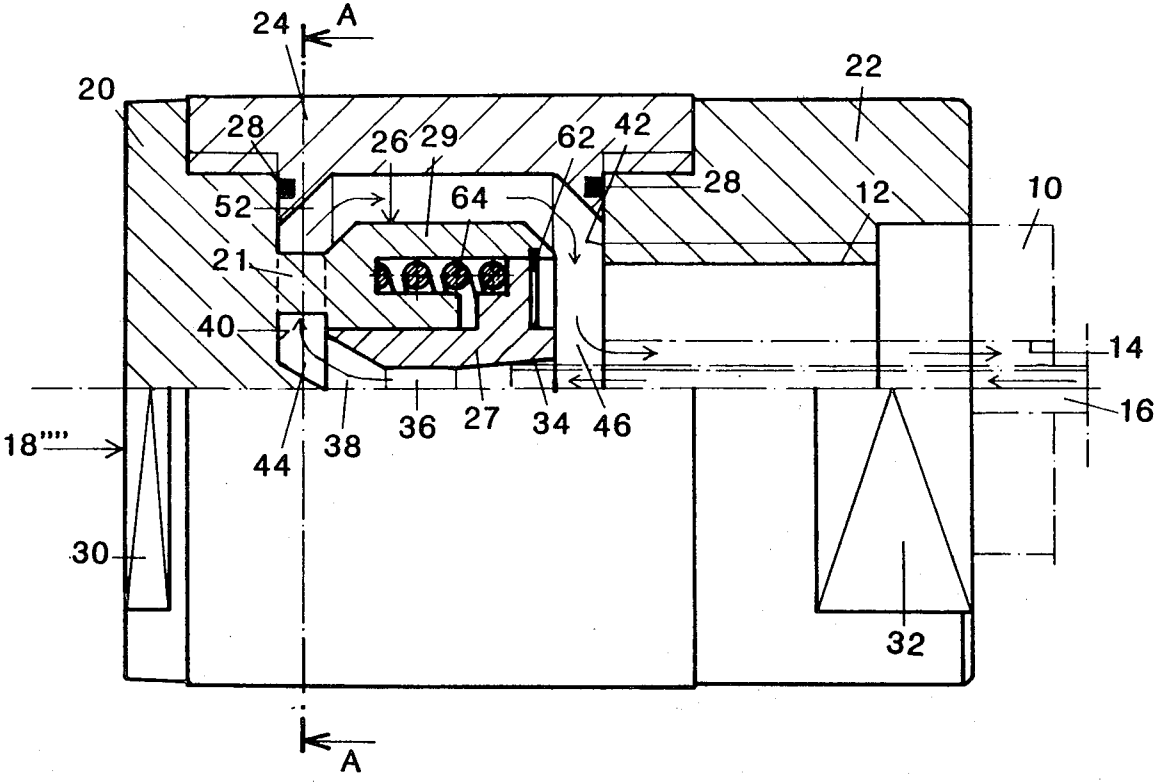
FIG. 5 shows a plunger, the front wall thereof and a mouth piece forming an integral unit.
Figure 6:
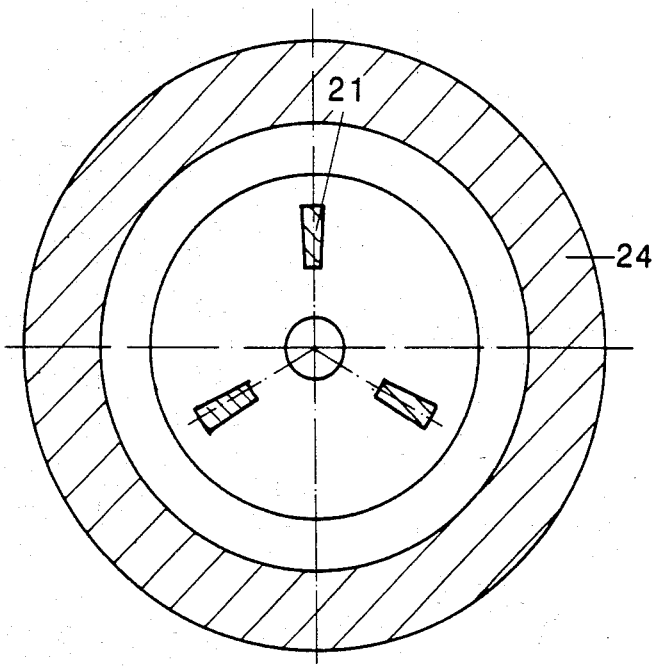
FIG. 6 shows a radial cross-section along line A—A of the plunger shown in FIG. 5.
Figure 8:
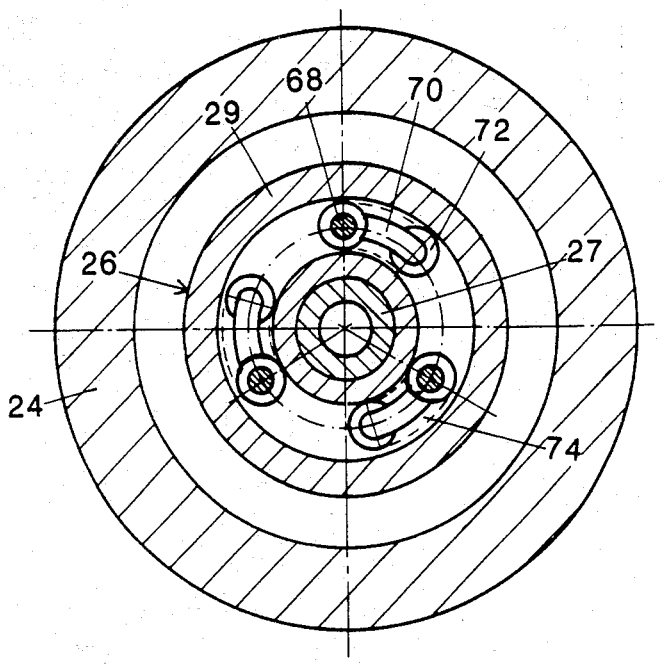
FIG. 8 shows a radial cross-section along line B—B of the plunger shown in FIG. 7.

The plunger 18$^{IV}$ (FIG. 5) has a mouth piece 26 consisting of an inside sleeve 27, an outside sleeve 29 and an axial spring 64 therebetween. The spring 64 rests at a front flange of the outside sleeve 29 and presses against an outwardly extending flange of the inside sleeve 27 thereby urging the inside sleeve 27 rearwardly and in contact with a retaining ring 62. The outside sleeve 29 is integrally connected with the front wall 20 by means of three thin-walled radial ribs 21 circumferentially arranged with equal interspaces. By this embodiment the outer mouth piece part and the plunger front wall form an integral undetachable rigid structure unit. The cooling liquid pipe 16 has an inside diameter substantially equal to that of the cylindrical middle portion 36 of the mouth piece 26. Therefore during screwing the plunger on the shaft 10, pipe 16 pushes against the conical rearward portion 34 and displaces the inside sleeve 27 of the mouth piece 26 forwardly until the plunger takes its end position. Thanks to this principle the mouth piece 26 at the whole outside surface but also at the whole inside surface is completely surrounded by the cooling liquid. Heat transferred via the ribs 21 to the mouth piece is completely carried off and no heat stagnation can arise as can be the case if the cooling liquid pipe is received within a long bore of a tube-like body leaving a small annular gap therebetween which forms a thermal heat transfer barrier. Further thanks to the self-adjusting principle no problems can arise during assembling if the longitudinal dimensions of plunger, pipe, shaft and mouth piece do not precisely match one another.

Figure 7:
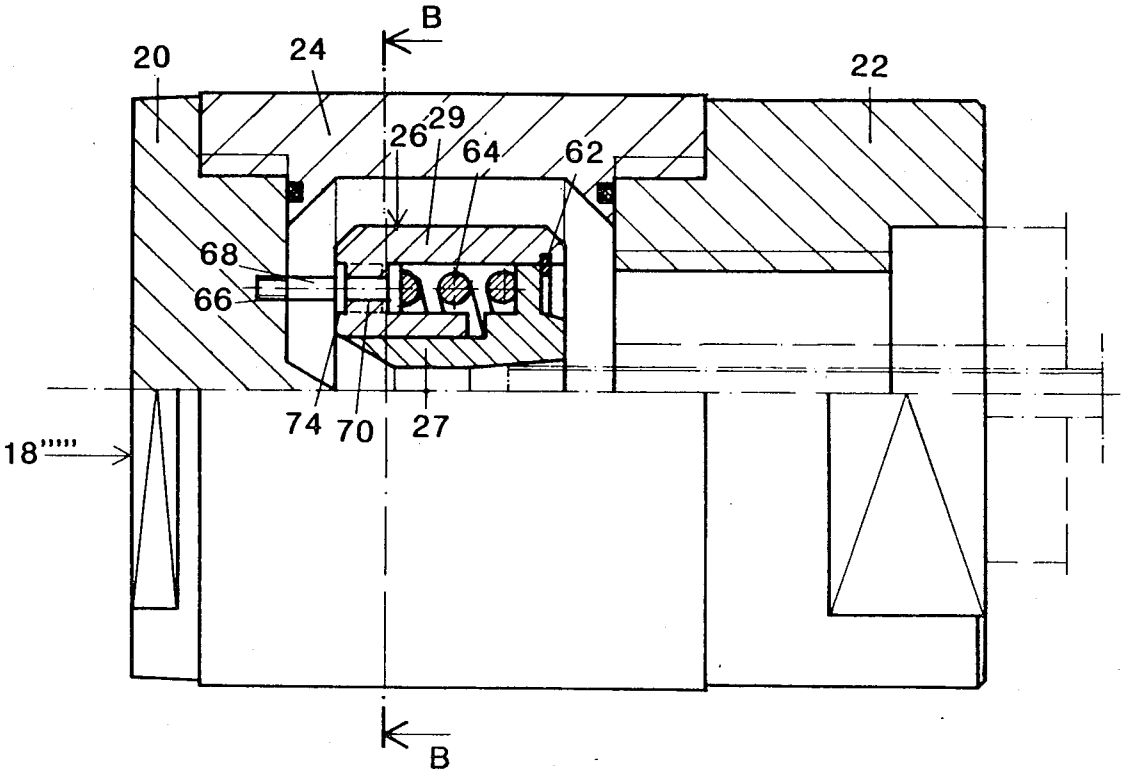
FIG. 7 shows a plunger having a mouth piece detachably fastened at the plunger front wall.

The plunger 18$^{V}$ according to FIG. 7 has a mouth piece 26 which also is composed of two parts 27, 29 and a spring 64 therebetween. The outside part 29 is detachably fastened at the front wall 20 by means of three thin axial pins 68 equally spaced in circumferential direction and fastened in thread holes 66 of the front wall 20. Each pin 68 has a pair of ring flanges at its end. The ring flanges have an interspace substantially equal to the wall thickness of the front flange of the outer sleeve 29 of the mouth piece 26. This front flange of the mouth piece 26 has three bores through which the end flanges of the pins 68 can be inserted into the annular chamber between the two parts 27, 29 of the mouth piece 26. A slot 70 adjoins circumferentially each one of the three bores and at the end of each slot a recess 74 is formed at the rearward inside of the front flange of the outer sleeve 29 for receiving the end flange of one of the axial pins 68. At the front side of that outer sleeve front flange a peripheral recess 72 is provided running along the slot 70 and which engages with the other flange of each axial pin 68 respectively. The mouth piece 26 therefore can be removably fastened at the plunger front wall 20 in a bayonet-socket-like manner in that the mouth piece 26 is axially moved forward until the end flanges of the axial pins 68 have passed the bores in the outer sleeve front flange and then rotated until the end flanges of the pins 68 reach the recesses 74 in which they are caught and held in position by the spring 64.

What is claimed is:

1. An improvement in a plunger in a die casting machine of the cold chamber type, the plunger comprising a front wall, a peripheral wall, a hollow shaft fastened to the plunger, a cooling liquid feed pipe, having a front opening, arranged within the hollow shaft leaving a circular discharge channel therebetween and projecting axially beyond the hollow shaft, a tube-like body arranged within the plunger and leaving an annular chamber between said peripheral wall and the tube-like body, the annular chamber communicating at axially opposite ends with the front opening of the feed pipe and the discharge channel respectively, the improvement comprising said tube-like body formed as a mouth piece spaced from the front wall of the plunger, a front end flow chamber formed between the front wall of the plunger and a front end face of the mouth piece, at least two small peripherally spaced holding means connecting the mouth piece and the plunger and holding the mouth piece coaxially aligned with said plunger, the annular chamber communicating at least substantially around its whole circumference thereof with both the front end flow chamber and the discharge channel.

2. A plunger as claimed in claim 1, wherein each one of the holding means comprises a separate holding element extending radially between the peripheral wall of the plunger and the mouth piece, said holding elements arranged with equal peripheral interspaces.

3. A plunger as claimed in claim 1, wherein the holding means comprises separate holding elements extending axially between at least one of opposite end faces of the mouth piece and the plunger.

4. A plunger as claimed in claim 3, wherein three holding elements are provided with equal peripheral interspaces between the front wall of the plunger and the adjacent front end face of the mouth piece, each holding element is formed as an axially extending pin fastened at one end to the front wall and provided with an enlargement at an opposite end thereof and wherein the mouth piece comprises a front wall having a bayonet-shape hole and slot arrangement for detachably fastening the mouth piece at the pins.

5. A plunger as claimed in claim 1, wherein radial ribs are provided at a rearward inside face of the front wall.

6. A plunger as claimed in claim 1, wherein at least a mouth piece part co-operating with the cooling liquid pipe is mounted in the plunger for axial movement between end stops and spring means are provided within the plunger reacting upon an axial displacement of the mouth piece.

7. A plunger as claimed in claim 1, wherein the front wall of the plunger comprises a central rearwardly extending projection forming a rotational solid continuously tapering in rearward direction.

8. A plunger as claimed in claim 1, wherein the mouth piece comprises an outside sleeve, an inside sleeve and a spring therebetween, the inside sleeve is guided in the outside sleeve for axial displacement and wherein the spring is pre-loaded forcing the inside sleeve in rearward direction.

9. An improvement in a plunger in a die casting machine of the cold chamber type, the plunger comprising a front wall, a peripheral wall, a hollow shaft fastened to the plunger, a cooling liquid feed pipe, having a front opening, arranged within the hollow shaft leaving a circular discharge channel therebetween and projecting axially beyond the hollow shaft, a tube-like body arranged within the plunger and leaving an annular chamber between said peripheral wall and the tube-like body, the annular chamber communicating at axially opposite ends with the front opening of the feed pipe and the discharge channel respectively, the improvement comprising said tube-like body formed as a mouth piece spaced from the front wall of the plunger, a front end flow chamber formed between the front wall of the plunger and a front end face of the mouth piece, at least two small peripherally spaced holding means connecting the mouth piece and the plunger and holding the mouth piece coaxially aligned with said plunger, the annular chamber communicating at least substantially around its whole circumference thereof with both the front end flow chamber and the discharge channel, said holding means consisting of axial projections integrally connecting the mouth piece with the front wall of the plunger, the projection arranged with equal peripheral interspaces.

10. An improvement in a plunger in a die casting machine of the cold chamber type, the plunger comprising a front wall, a peripheral wall, a hollow shaft fastened to the plunger, a cooling liquid feed pipe, having a front opening, arranged within the hollow shaft leaving a circular discharge channel therebetween and projecting axially beyond the hollow shaft, a tube-like body arranged within the plunger and leaving an annular chamber between said peripheral wall and the tube-like body, the annular chamber communicating at axially opposite ends with the front opening of the feed pipe and the discharge channel respectively, the improvement comprising said tube-like body formed as a mouth piece spaced from the front wall of the plunger, a front end flow chamber formed between the front wall of the plunger and a front end face of the mouth piece, at least two small peripherally spaced holding means connecting the mouth piece and the plunger and holding the mouth piece coaxially aligned with said plunger, the annular chamber communicating at least substantially around its whole circumference thereof with both the front end flow chamber and the discharge channel, a bore of the mouth piece having a cylindrical middle portion and end portions continuously enlarging toward each end face of the mouth piece.

* * * * *